United States Patent [19]

Takahashi

[11] Patent Number: 4,803,355

[45] Date of Patent: Feb. 7, 1989

[54] MASS SPECTROMETER

[75] Inventor: Sadao Takahashi, Katsuta, Japan

[73] Assignee: Hitachi, Ltd., Tokyo, Japan

[21] Appl. No.: 30,179

[22] Filed: Mar. 26, 1987

[30] Foreign Application Priority Data

Mar. 26, 1986 [JP] Japan ..... 61-65708

[51] Int. Cl.[4] ..... H01J 49/04

[52] U.S. Cl. ..... 250/288; 250/304

[58] Field of Search ..... 250/288, 309, 282, 288 A; 436/173, 178

[56] References Cited

U.S. PATENT DOCUMENTS 3,508,045 4/1970 Andersen et al. ..... 250/282

*Primary Examiner*—Bruce C. Anderson
*Assistant Examiner*—Jack I. Berman
*Attorney, Agent, or Firm*—Antonelli, Terry & Wands

[57] ABSTRACT

A mass spectrometer includes apparatus for irradiating a target with a primary beam, apparatus for forwarding the target from the outside of a vacuum chamber, apparatus for analyzing the mass of secondary ions emitted by the target, and apparatus for collecting data on the secondary ions thus mass-analyzed. Further, apparatus is provided for synchronizing the timing for the forwarding of the target and that for the data collection and for stopping substantially the data collection during a predetermined period of time (T) after the stopping of the forwarding of the target.

6 Claims, 2 Drawing Sheets

MASS SPECTROMETER

BACKGROUND OF THE INVENTION

This invention relates to a mass spectrometer and in particular to a mass spectrometer suitable for the secondary ion mass spectrometry (hereinbelow abbreviated to SIMS) for analyzing specimens developed on a thin layer chromatogram (hereinbelow abbreviated to TLC) plate. Here SIMS means the mass spectrometry of secondary ions emitted from a target irradiated with a primary ion beam or a neutral particle beam.

Recently TLC/SIMS is utilized for analyzing specimens developed on a TLC plate according to SIMS. Some examples concerning the summary of this method are described in the preprint of the joint discussion meeting of the Mass Spectrometry Society of Japan 1985, p. 148–p. 151.

According to the measurement method, when specimens developed on a TLC plate are sampled, at the moment where the plate is forwarded, collection of data is stopped and at the moment where the forwarding of the plate is stopped, the collection of data is started again. Data of peaks of a spectrum on a chromatogram are obtained continuously by repeating the steps described above.

According to the prior art techniques, data collection is started with the timing, where the forwarding of the plate is stopped (in practice the magnetic field for obtaining the mass spectra is swept). The states, where the plate is irradiated with a primary ion beam and secondary ions are emitted, when the plate is forwarded and when it is stopped, are naturally different and emission of secondary ions is stable only after a certain time has lapsed from the stopping of the plate. This is because the state of the matrix of glycerol, etc. is changed by primary ions projected to the plate and thus, when the plate is forwarded, new matrices are succeedingly irradiated so that there is no time for the matrix effect to achieve a steady state. Here the matrix effect means the action of the matrix to alleviate the shock produced by energy of primary ions, the action of the matrix to repair destroyed matrix owing to the viscosity of the matrix, etc. In order to have a steady matrix effect, it is necessary that a determined matrix state is irradiated with a primary ion beam during a certain period of time. Consequently, in order to obtain a stable mass spectrum, it is necessary to collect data, starting from a point of time, where the matrix effect achieves a steady state.

SUMMARY OF THE INVENTION

The object of this invention is to provide a mass spectrometer permitting removal of instabilities of the data during an early period of time after the stopping of the forwarding of the target and to obtain a mass spectrum having a normal pattern.

According to this invention the timing for the forwarding of the target and the timing for the data collection are synchronized and means for stopping substantially the data collection during a certain period of time after the forwarding of the target has been stopped is provided.

By such means, since the data collection is started after the secondary ion emission has been stabilized after the stopping of the target, it is possible to obtain a mass spectrum having a normal pattern.

DESCRIPTION OF THE PREFERRED EMBODIMENTS

Figure 1:
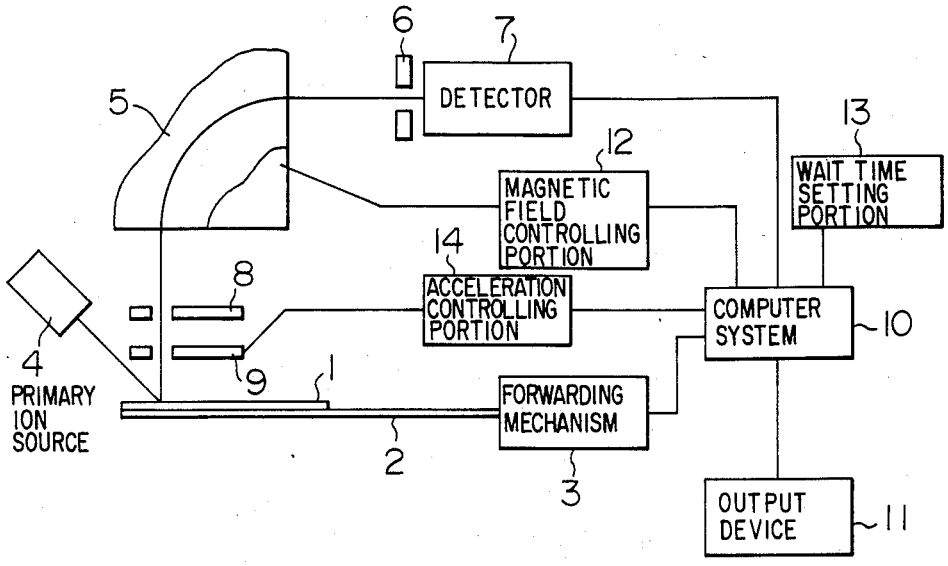
FIG. 1 is a block diagram illustrating an embodiment of the mass spectrometer according to this invention.
Figure 3:
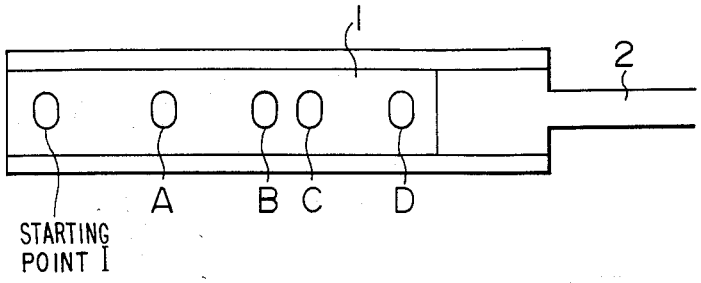
FIG. 3 shows mixed specimens developed on a TLC plate, which is used as a target.

An embodiment of this invention will be explained below, referring to FIG. 1. In FIG. 1 an ion beam generated by a primary ion source 4 is accelerated to about 8 keV and projected to the target 1. Specimens applied on the target are sputtered and a part of them is ionized (secondary ions). These secondary ions are principally molecular. Since a primary ion acceleration voltage of 3 kV is applied to the specimen holder 2, the energy of the ions impinging on the target is 5 keV. On the other hand the acceleration energy of the secondary ions is 3 keV. The secondary ions pass through a collector slit 6 and are detected by a detector 7 after having passed through a lens 9 for accelerating the secondary ions and an objective slit 8 and being separated according to their electric charge to mass ratio. The lens 9 for accelerating the secondary ions and the magnetic field 5 are controlled by an acceleration controlling portion 14 and by a magnetic field controlling portion 12, respectively. Signals thus detected are recorded by an output device 11 after having been treated by a computer system 10. Usually, it is possible to record all the ions having electric charge to mass ratios in a desired range by varying the magnetic field strength or the secondary ion acceleration voltage. On the other hand, specimens developed on the TLC plate are ionized one after another, measured and recorded by forwarding the specimen holder 2 by means of the forwarding mechanism 3. FIG. 3 shows an example of specimens developed on a TLC plate as a target. That is, mixed specimens A, B, C and D are put at the starting point I. When they are analyzed by the TLC method, they are developed into the components A, B, C and D, as indicated in the figure. The plate is cut into a plurality of elongated rectangles, each of which is charged on the specimen holder 2 as the target.

Figure 4:
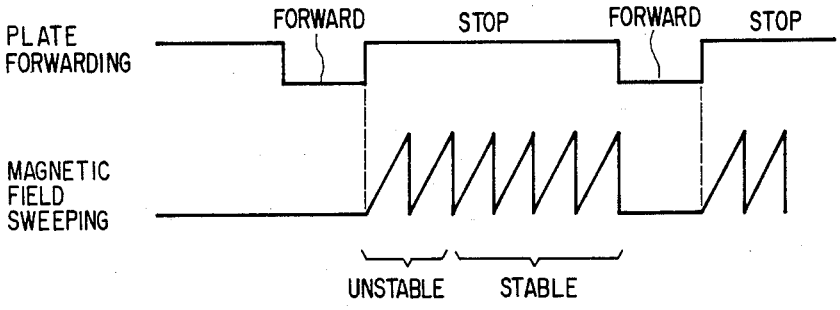
FIG. 4 PRIOR ART
FIG. 4 shows the relation between the timing for the forwarding of the target and the timing for the data collection according to the prior art techniques.

Usually the timing for the forwarding of the plate as the target and that for the magnetic field scanning for the data collection are as indicated in FIG. 4. Starting from the point of time, where the plate is stopped, the magnetic field scanning is repeated and data are collected. However, during the early period of time after the stopping of the plate the matrix on the plate doesn't reach its stable region due to the irradiation with primary ions. (i.e. the matrix effect is not constant.) For this reason the sensitivity was low, the mass spectrum pattern was unstable and thus it was not possible to obtain normal data.

Figure 2:
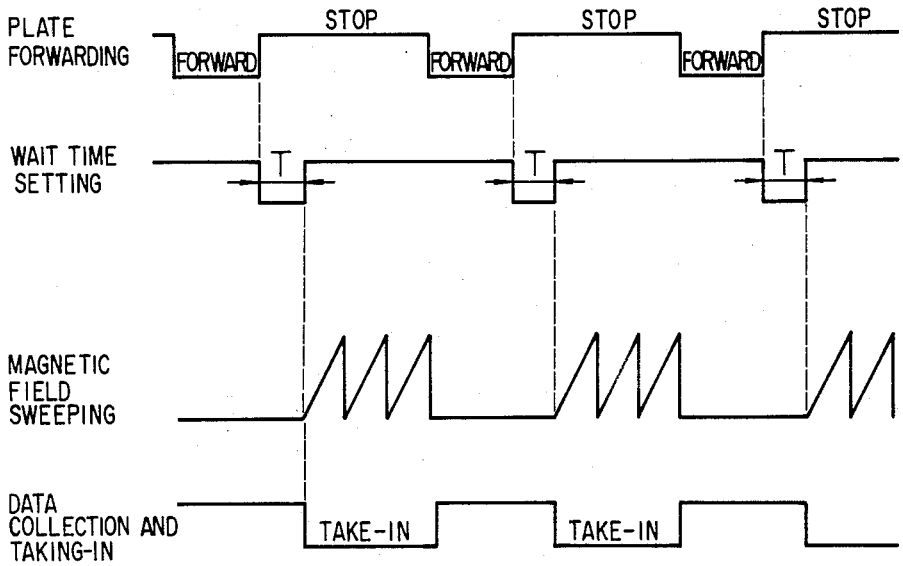
FIG. 2 shows the relation between the timing for the forwarding of the target and the timing for the data collection for the mass spectrometer illustrated in FIG. 1.

In order to resolve this problem, according to this invention, a method is adopted, by which it is prevented to collect data in the unstable region so as to obtain normal data by providing a mechanism for setting the wait time T with a timing according to the stopping of the plate forwarding, as indicated in FIG. 2, which enables initiation of the magnetic field sweeping only after this wait time T has lapsed. This wait time T is necessarily a period of time, after which the matrix effect becomes constant. This period of time, after which the matrix effect becomes constant, depends on the material constituting the matrix, the substances which are the specimens, the voltage applied to the primary ion source, etc. The same effects can be obtained also by retarding the timing for taking-in data from obtained mass spectrum signals, i.e. the timing of input from the detector 7 to the computer system 10, by the time T, while the magnetic field sweeps for the data collection.

In the above embodiment, although the primary beam, with which the target is irradiated, is an ion beam, it may be also a neutral particle beam. Even if neutral particles impinge on the target, particles emitted by the target are said to be secondary ions.

As stated above, the provision for starting and stopping of the data collection includes not only the turning on/off of the taking-in of the mass spectrum signals into the computer system, but also the turning on/off of the magnetic field sweeping or the acceleration voltage sweeping for obtaining the mass spectrum signals. Furthermore it is also includes the provision of starting and stopping of the data collection to treat data, while leaving the data corresponding to the unstable region stated above undealt with in the computer system by means of a suitable program.

According to this invention, it is possible to remove instability in the data obtained at the early period of time after the stopping of the target forwarding and to obtain mass spectra having normal patterns.

I claim:

1. A mass spectrometer comprising:

means for irradiating a target with a primary beam;

means for forwarding said target from outside of a vacuum chamber;

means for analyzing the mass of secondary ions emitted by said target;

means for collecting data on the secondary ions thus mass-analyzed; and means for synchronizing the timing for the forwarding of said target and that for the data collection and for stopping substantially the data collection during a predetermined period of time (T) after stopping of the forwarding of said target.

2. A mass spectrometer according to claim 1, in which said means for stopping substantially the data collection is means for turning-off the taking-in of mass spectrum signals into a computer system.

3. A mass spectrometer according to claim 1, in which said means for stopping substantially the data collection is means for turning-off a magnetic field sweeping for obtaining mass spectrum signals.

4. A mass spectrometer according to claim 1, in which said means for stopping substantially the data collection is means for turning-off an acceleration voltage sweeping for obtaining mass spectrum signals.

5. A mass spectrometer according to claim 1, in which said predetermined period of time (T) is a period of time, which is necessary for a matrix effect to become constant.

6. A mass spectrometer according to claim 1, in which said target is a specimen developed on a thin layer chromatogram plate and the mass spectrometer performs secondary ion mass spectrometry of the secondary ions emitted from said target.

* * * * *